United States Patent [19]

Ford

[11] 4,007,359

[45] Feb. 8, 1977

[54] POSTAGE METER

[75] Inventor: Frederick L. Ford, Bradenton, Fla.

[73] Assignee: Pitney-Bowes, Inc., Stamford, Conn.

[22] Filed: Aug. 14, 1975

[21] Appl. No.: 604,724

[52] U.S. Cl. ..... 235/101; 101/91

[51] Int. Cl.[2] ..... G07G 1/00

[58] Field of Search ..... 101/91; 235/91 AR, 101

[56] References Cited

UNITED STATES PATENTS

| | | | |
|---|---|---|---|
| 1,639,384 | 8/1927 | Pitney | 235/101 X |
| 2,727,687 | 12/1955 | Komusin | 235/101 |
| 3,583,314 | 6/1971 | Gillender | 235/101 X |

*Primary Examiner*—Ulysses Weldon
*Attorney, Agent, or Firm*—William D. Soltow, Jr.; Albert W. Scribner; Robert S. Salzman

[57] ABSTRACT

A postage meter is disclosed which features a rotatable printing drum. The print wheel(s), registers, and postage value selector are all supported by the drum to provide a reduction in parts. The postage meter is more reliable due to the reduction of parts, as well as being more compact and less costly to manufacture. The print wheel(s) of the meter are offset from a valid print position when the drum is in a rest position, in order to provide protection against "wiping off". The postage value selector is easily operable by the postage meter user and is conveniently disposed for ease of access.

19 Claims, 8 Drawing Figures

POSTAGE METER

This invention pertains to postage meters and more particularly to a postage meter having a novel printing drum construction and tamper proof features.

BACKGROUND OF THE INVENTION

Heretofore, postage meters have tended to separate the printing mechanism from the registers and the postage selector. Such separation, while convenient, required intricate interconnecting linkages to safeguard against tampering and to provide a proper accounting of printed postage.

The present invention was conceived as means of reducing or eliminating the interconnecting linkages of the meter. This reduction of parts was expected to improve reliability, lower manufacturing costs, and provide a machine with greater portability and compactness.

DESCRIPTION OF THE PRIOR ART

A relatively simple portable postage meter machine is disclosed in United States Patent No. 1,639,384 to A. H. Pitney. The postage meter there described utilizes a meter drum rotatably mounted upon a fixed spindle and containing within the drum ascending and descending registering mechanisms and the stamp imprinting die. Upon effective rotation of the meter drum the printing face of the die cooperates with an impression roller to imprint a stamp upon an envelope. Although the die is multiple faced so that different demoninations may be imprinted, the faces can be exposed for printing only by directly turning the spindle upon which the triangular die is mounted. According to the patent, this adjustment requires partial disassembly of the meter drum components and the use of a screwdriver inserted in a notch in the end of the die spindle. Thus, changing the denomination of the postmark stamp to be printed is therefore inconvenient and not readily accomplished. With the varying amounts of postage required for differing weights of letters and different types of articles to be mailed in today's business enterprises, it is desirable to readily change the value to be imprinted by mere hand actuation of selector dials. Moreover, in a postage meter such as is shown in U.S. Pat. No. 1,639,384, a risk exists that an envelope may be inserted in the housing within the meter casing shell, so that an impression of postage value may be obtained by so called "wiping a stamp" without rotating the drum meter for the die to come in contact with the impression roller. The lack of a simple security device to avoid this unauthorized use is a serious disadvantage.

There currently exist value dispensing mechanisms incorporating security features and having rotatable assemblies in which both the value dispensing means rotate and a setting mechanism capable of setting a wide range of dispensible postage amounts rotates with the assembly. See, for example, U.S. Pat. Nos. 3,682,378 and 3,731,068. In the devices shown in those patents, the mechanism for setting the postage value is assembled with the printing mechanism for rotation therewith and includes selector wheels which are coaxially rotatable, and setting bars which are longitudinally translatable, in response to rotation of the selector wheels. Those value dispensing mechanisms are of a more sophisticated design than the simple low cost rotary drum meter of the type shown in U.S. Pat. No. 1,639,384.

SUMMARY OF THE INVENTION

The invention relates to a postage meter having a rotatable printing drum that contains the postage value selector, the registers, and the print wheel(s). The selector is in the form of (an) easily accessible and easily operable thumb wheel(s), which is (are) rotated to set the print wheel(s) to the proper postage value. The print wheel(s) are interconnected to the selector thumb wheel(s) in such a way, that they are offset from a proper print position when the printing drum is at rest. The offset position of the print wheel(s) prevents a "wiping off" of the postage impression. "Wiping off" is a practice known in the postage meter art as a way of obtaining a postage printing without it being registered (accounted for) by the meter. The invention precludes a postage impression from being wiped from the print wheel(s), by causing the numerical amount of postage to be offset within the insignia window of the postage stamp die. An attempt to "wipe off" this offset amount will result in obtaining an impression that will visually appear invalid or otherwise improper.

When postage is desired to be printed in normal fashion, the printing drum of the postage meter is rotated from its rest position through a metering cycle. As the drum rotates, the linkage connecting the selector thumb wheel(s) and the print wheel(s) disengages, and in so doing, causes the print wheel(s) to assume a proper aligned print position within the insignia window of the postage stamp die.

Other interconnecting linkage between the selector and the registers, provides that the printed postage is recorded by the registers as the print drum rotates.

The print drum is accelerating from its rest position until it obtains a constant speed through the printing portion of the metering cycle. After the drum has rotated through the printing portion of the cycle, it then decelerates back to the rest position. The mechanism for providing this particular drum movement is a planetary gear system which is integrally and operatively united with a geneva-type cam system. This integral cam and gear system provide the specific drum speed rotation necessary to produce a clear, sharp postage impression.

It is an object of this invention to provide an improved postage meter;

It is another object of the invention to provide a postage meter having less parts, so as to reduce the costs of manufacture and to improve reliability;

It is a further object of this invention to provide a compact, portable-type postage meter.

These and other objects of the invention will become more apparent and better understood with reference to the following description taken in conjunction with the attached drawings in which:

FIG. 1 is a cutaway perspective view of the postage meter of this invention;

FIG. 1*a* is an internal side view of the postage meter of FIG. 1 showing the internal mechanism in an at rest position;

FIGS. 2*a* and 3*a* are side views of the internal mechanism depicted in FIG. 1*a*, while in sequential movement through a postage metering cycle; FIG. 2*a* illustrating the mechanism prior to printing and FIG. 3*a* showing the mechanism after printing;

DETAILED DESCRIPTION

Generally speaking, the invention is for a postage meter having a rotatable drum. The drum comprises a directly accessible, hand manipulatively settable postage value selector means, a variable postage printing means, and a postage registering means. The printing means and the registering means is only operable upon rotation of the drum from a rest position through a metering cycle. The printing means comprises at least one rotatable die wheel containing a plurality of postage values on its periphery. The die wheel is rotatably movable between an offset position and a properly aligned print position upon rotation of the drum from the rest position through the metering cycle.

Figure 1:
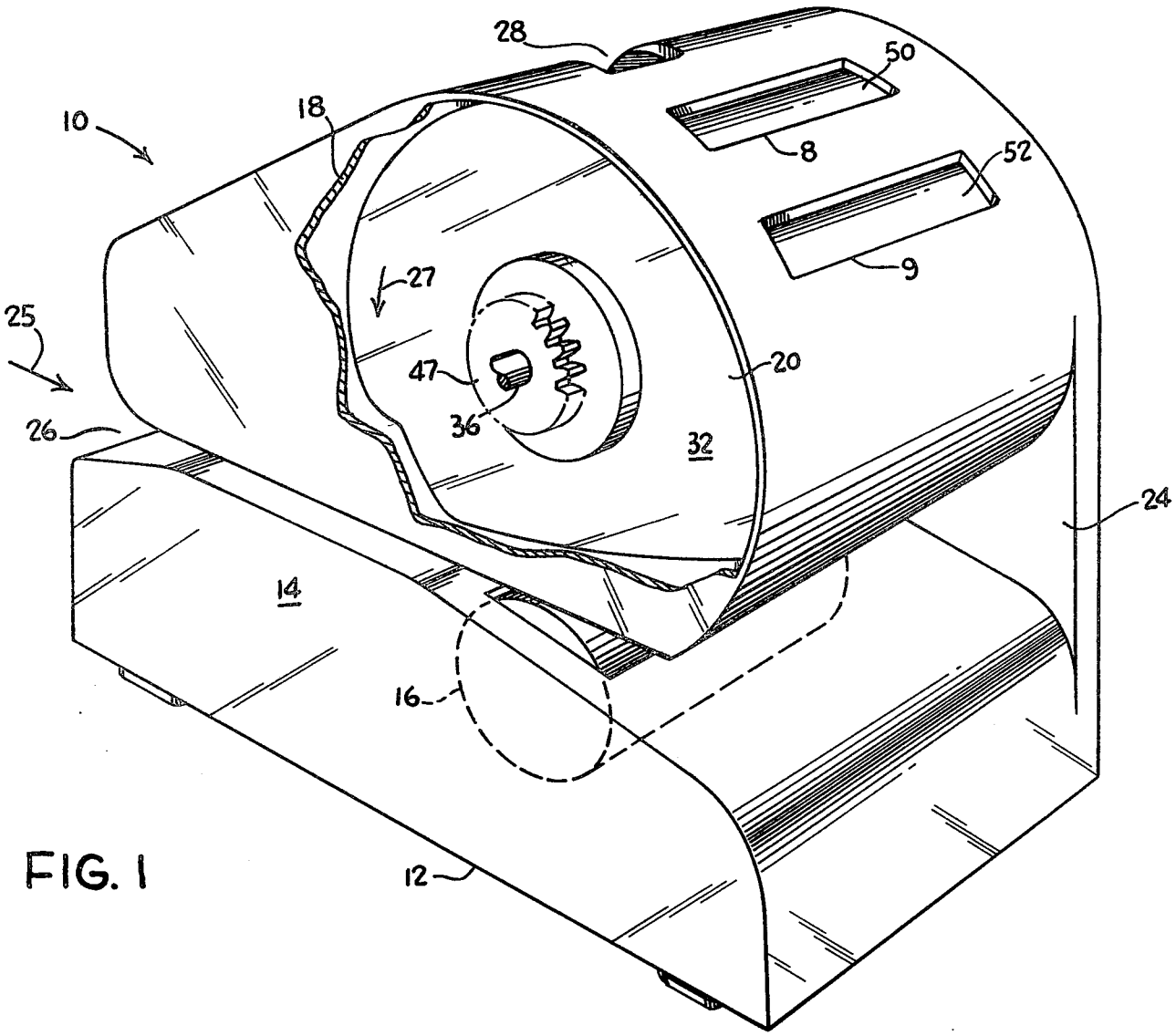
Figure 1A:
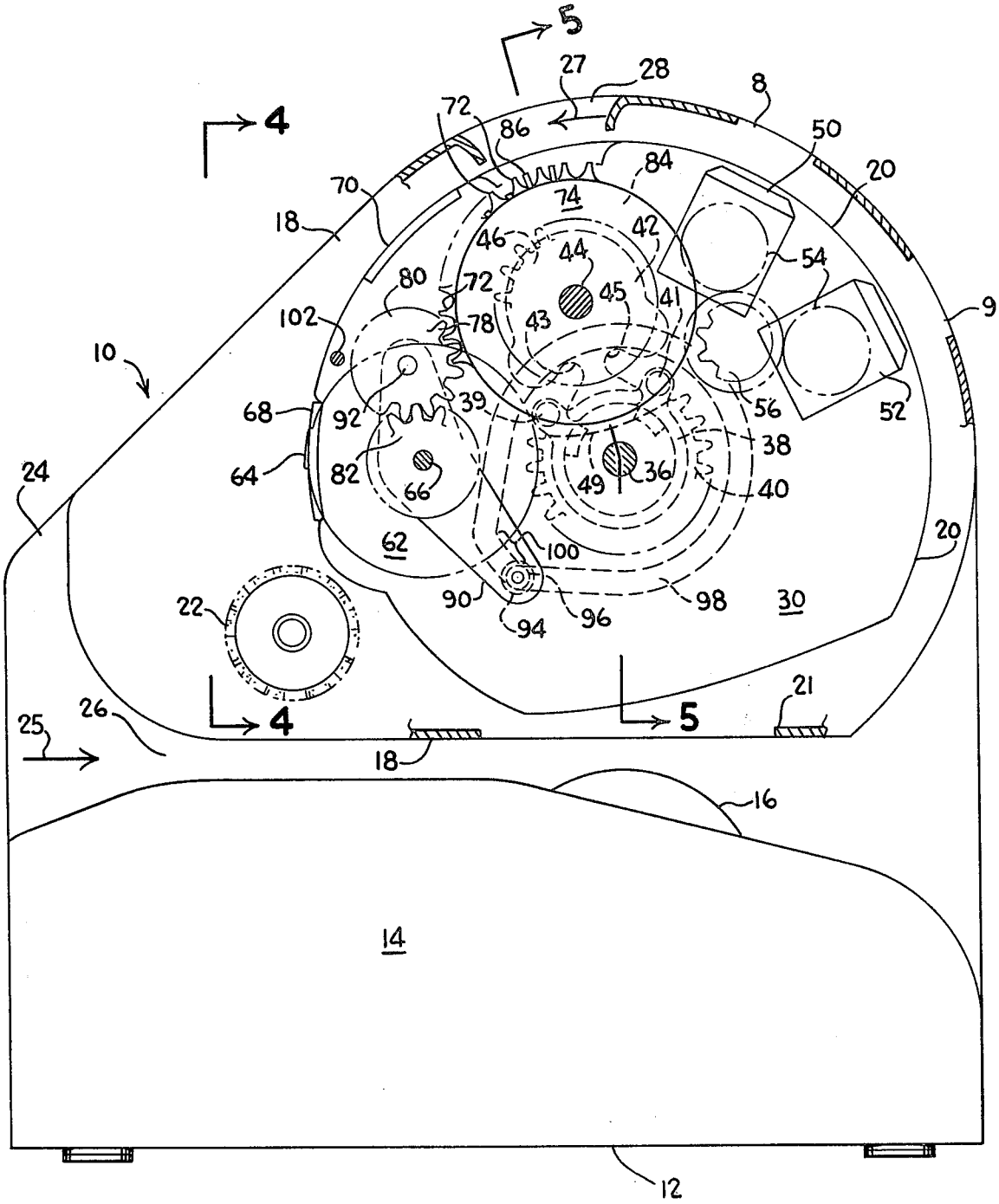
Figure 5:
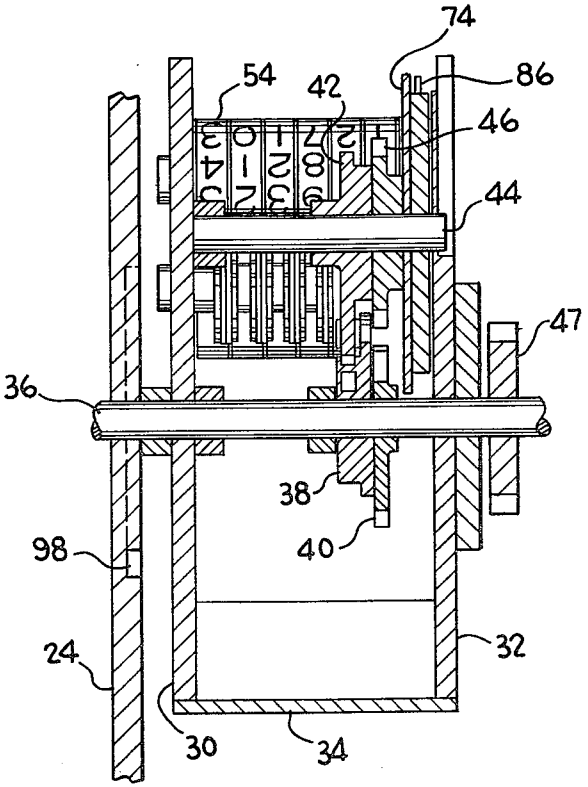
FIG. 5 is a sectional view of FIG. 1*a* taken along lines 5—5.

Now referring to FIGS. 1 and 1*a*, a perspective and side view, respectively, is shown of the inventive postage meter 10 and its internal mechanism. The postage meter 10 has a base 12 including a lower cover (housing) 14. An impression roller 16 is rotatably mounted within the housing 14. An upper cover or housing 18 encloses a rotatable drum assembly 20. The drum assembly 20 contains an easily accessible, manually settable, postage value selector dial 74 (FIGS. 1*a* and 7), for selecting the amount of postage to be printed on a piece of mail. The drum assembly 20 also contains at least two registers 50 and 52, respectively. Register 50 is a balance counter or descending register that maintains a numerical record of the credit balance. Register 52 is an ascending or total register that provides a cumulative total of all the postage that has ever been dispensed from the meter 10. These registers comprise many commercial orders that are represented by the display wheels 54 (FIGS. 1*a* and 5).

The registers 50 and 52 can be read by looking through windows 8 and 9, respectively disposed upon the housing 18.

The selector dial 74 (FIG. 1*a*) can be set to a postage amount by reaching through window 28 in housing 18, and thumbing the selector teeth 72 (FIG. 1*a*) to a desired rotative position. The selector dial 74 controls a print die wheel 62 (FIGS. 1*a* and 7) having a plurality of postage die amounts 64 disposed upon the periphery. The print die wheel 62 imprints a piece of mail with the selected postage amount. This is accomplished by inserting a piece of mail or envelope (arrow 25) into slot 26 defined by the upper and lower housings 14 and 18, respectively. The drum assembly 20 is caused to turn as illustrated by arrow 27, bringing the postage die 64 in contact with inking roller 22 (FIG. 1*a*) and then into contiguous adjacency with impression roller 16, (see FIGS. 2*a* and 3*a*, respectively). The letter in slot 26 will receive a postage imprint as the die 64 rolls over the letter disposed upon impression roller 16. The drum assembly 20 then rotates back to its initial position as depicted in FIG. 1*a*. A window 21 (FIG. 1*a*) is disposed in the bottom of cover 18 opposite the impression roller 16, to allow the die 64 to contact the letter.

Figure 2A:
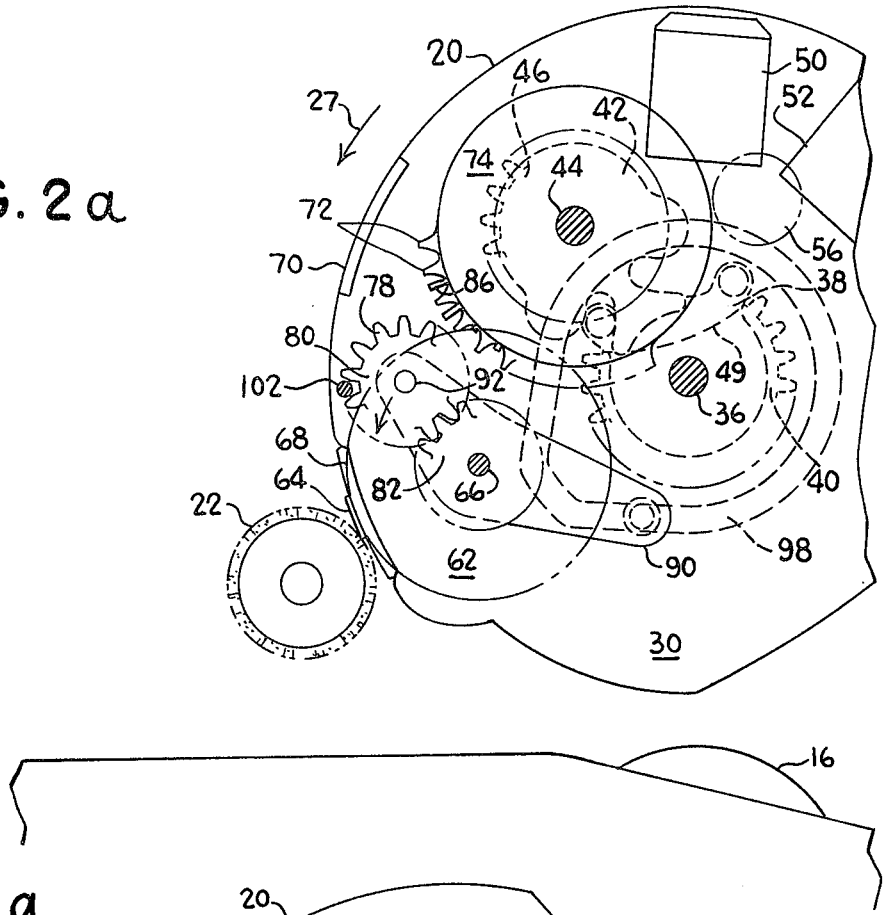
Figure 3A:
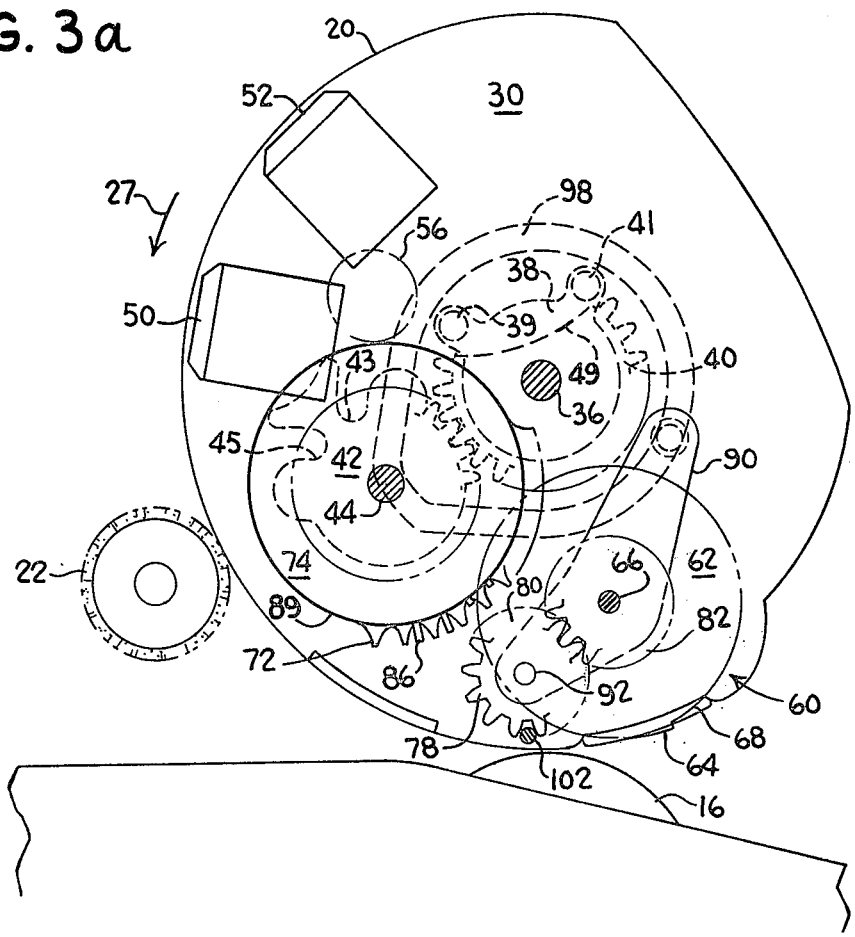

The drum assembly 20 rotates about the fixed shaft 36, which is anchored into plate 24. The drum assembly 20 comprises two end plates 30 and 32 (FIGS. 4 and 5) joined together by an intermediate cylindrical casing 34. As shown in FIGS. 1*a*, 2*a*, and 3*a*, the end plates 30 and 32 are essentially circular with truncated portions to permit envelopes to feed between the drum assembly 20 and the impression roller 16. The letter self feeds through, and ejects from, the slot 26, when the circular portions of the end plates press against the letter disposed upon the impression roller 16.

Figure 4:
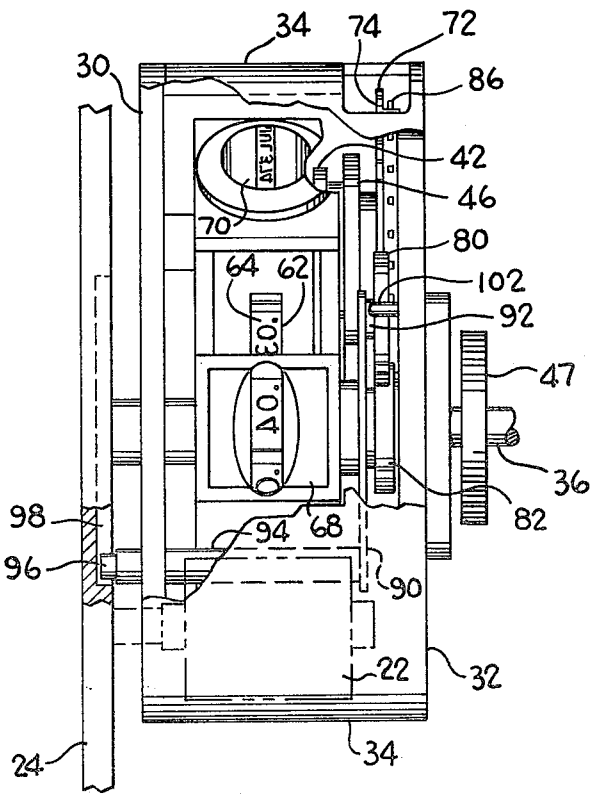
FIG. 4 is a sectional view of FIG. 1*a* taken along lines 4—4.

The drum assembly 20 is caused to turn via driving gear 47, which is rotatably mounted upon shaft 36, and is affixedly secured to plate 32 (FIGS. 1, 4, and 5). Gear 47 may be driven either by a motorized or a manual means.

The drum assembly 20 is shown in an initial or at rest position in FIG. 1*a*. The assembly 20 is then caused to turn in the direction shown by arrow 27, and the sequential positions of FIGS. 2*a* and 3*a*, respectively. The drum assembly completes a full metering cycle, when it returns to its at rest position depicted in FIG. 1*a*. The drum is initially accelerated from the initial position (FIG. 1*a*) to a constant speed through the print portion (FIGS. 3*a*) of the metering cycle. Just before the drum comes back to the rest position, it naturally is decelerated. The motion of drum assembly 20 is achieved by means of an integrally combined geneva mechanism and sun and planetary gearing, which will best be described with particular reference to FIG. 6. As aforementioned, the drum rotates about shaft 36. Shaft 36 supports a stationary sun gear 40 about which a planetary gear 46 revolves. Integrally combined with the planetary gear 46 and sun gear 40 is a geneva cam mechanism comprising a stationary combination cam 38 and a follower butterfly cam 42. The butterfly cam 42 is integral with the planetary gear 46, such that as the planetary gear 46 revolves about the stationary sun gear 40, the butterfly cam 42 revolves about stationary combination cam 38; cam 38 being integral with sun gear 40 on shaft 36.

Figure 6:
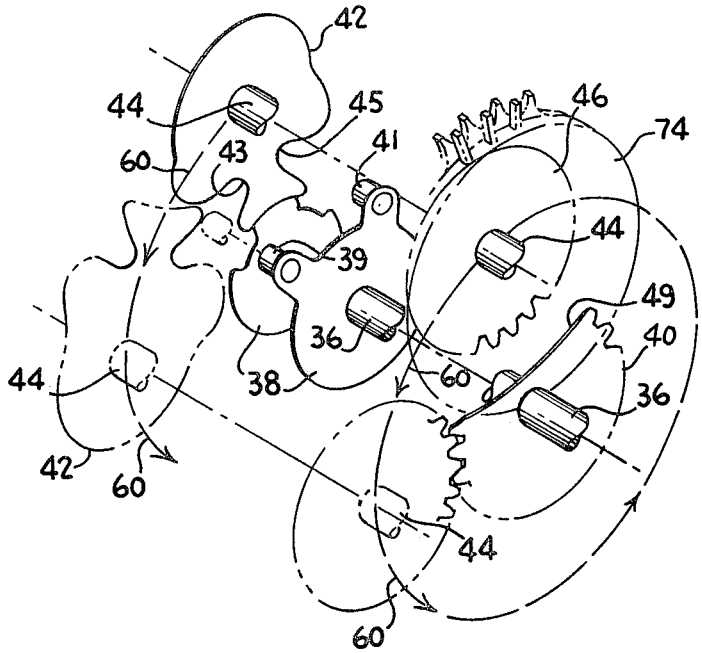
FIG. 6 is an exploded schematic perspective view of the geneva mechanism and the sun and planetary gears of the internal mechanism of FIG. 1*a*, showing the rotational path for the butterfly cam and the planetary gear; the solid lines depicting these elements in an at rest position, and the phantom lines illustrating these elements in movement through a postage metering cycle.

The solid lines of FIG. 6, show the cam and gear mechanisms in the at rest position of FIG. 1*a*. Arrows 60 denote the revolutionary path of cam 42 and gear 46 about center shaft 36. The phantom lines denote a revolutionary sequential cam 42 and gear 46 position with respect to fixed shaft 36, coincident with the position of the drum in FIG. 3*a*. The cam 42 and gear 46 are carried by shaft 44, which is rotatably fixed between the drum plates 30 and 32 (FIG. 5). Thus, it can be seen that as the drum will rotate about shaft 36, the cam 42 and the gear 46 revolve about their mating cam and gear members.

The butterfly cam 42 will provide an acceleration to the drum assembly 20 as the slot 43 engages with pin 39 of combination cam 36. During this time, the planetary gear 46 does not engage sun gear 40, because sun gear 40 has an upper eclipsed section 49. This eclipsed section 49 provides no engagement for the teeth of planetary gear 46 during the acceleration phase of cam 42. In other words, only butterfly cam 42 is operative during start-up to influence the motion of the drum 20. As aforementioned, this is the accelerated phase of the metering cycle due to the caming action of the butterfly cam 42.

As the drum 20 approaches the printing portion of the metering cycle, it will be seen that the butterfly cam 42 (phantom lines of FIG. 6) is now revolving free of combination cam 38. At this juncture, the planetary gear 46 begins to mesh with sun gear 40 providing a constant speed for drum 20.

The drum 20, via shaft 44 and gear 46, continues to revolve about shaft 36 at constant speed. This continues until the eclipsed section 49 of gear 40 is reached on the back portion of the metering cycle. At such time, the gears 40 and 46 disengage, and the slot 45 of butterfly cam 42 engages with pin 41 of combination cam 38. The engagement of the butterfly cam 42 with cam 38 now provides a deceleration for drum assembly 20. The drum now decelerates to a stop (the "at rest" position depicted in FIG. 1*a*).

Figure 7:
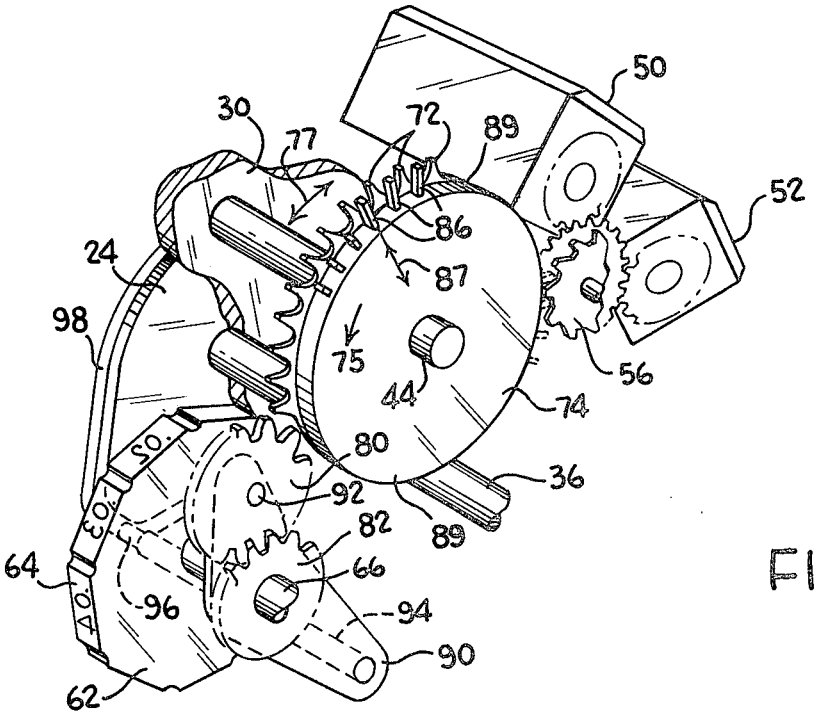
FIG. 7 is a partial perspective view of the internal mechanism of FIG. 1*a*, depicting the selector mechanism, printing die wheel, registers, and associated gearing.

As aforementioned, the drum assembly contains a postage selector dial 74, which is shown in partial phantom in FIG. 6, and in solid perspective in FIG. 7. The selector dial 74 is fixedly mounted to gear 46. As the gear 46 revolves about gear 40 (arrows 60), the selector dial 74 is caused to rotate as shown by arrow 75 of FIG. 7. The teeth 72 of dial 74 can be thumbed in a forward or reverse direction (arrows 77) about shaft 44, because they are rotatably mounted within dial 74. The teeth 72 set the desired postage for the print die wheel 62, by engaging with gear 80. Gear 80 meshes with gear 82, which is fixedly mounted to the print die wheel 62 via shaft 66. Thus, as the teeth 72 are caused to be rotated (arrows 77) within the dial 74, the print die wheel 62 will be rotated to a new print die 64 position.

The selector dial 74 also comprises a ducking tooth mechanism, whose teeth 86 are caused to project into, and out of, the dial surface 89, as shown by arrows 87. These ducking teeth are controlled by thumbing selector teeth 72. In other words, as the selector teeth 72 are rotated as shown by arrows 77, the ducking teeth extend into, and out of, dial surface 89 as shown by arrows 87.

The outwardly extending ducking teeth 86 engage with the register gear 56 as the selector dial rotates (arrows 75) to a registering position during the final portion of the drum assembly travel (metering) cycle. As will be obvious to the observer, the more ducking teeth 86 extending outwardly from dial surface, the more gear 56 will be caused to turn. Thus, it will be seen, that selection of a greater or lesser amount of postage will effect a greater or lesser amount of turning for registers gear 56. This will naturally result in a greater or lesser amount of registration in ascending and descending registers 52 and 50, respectively.

In the embodiment shown, there is but one print wheel 62 having varying postage die amounts 64 on its peripheral face. It will be understood by those skilled in this art that a plurality of coaxially rotatable print wheels may be provided with corresponding plurality of coaxially rotatable selector dials 74 as well as driven register gears 56 for selecting a wide variety of amounts, and having these amounts printed as postage and registered as inputs in the numerical registers. Thus, several suitable orders may be provided to dispense postage of wide value. For example, in the event that several coaxial print wheels are to be provided in the same alignment as shown by the single print wheel 62, the feed of envelopes would have to be rotated 90 degrees and the date and dies would be provided on the periphery of the drum in a relationship parallel to the drum shaft 36. Other arrangements for providing several decimal orders for value dispensing may be provided, as is known in the art.

Referring to FIG. 4, it will be seen, that the casing 34 of the drum contains a postage indicia stamp die 68. The die face 68 is rectangular in form and carries all the identification marks required by the Government for a proper postage impression.

The die face 68 is carried on the periphery of the rotatable drum assembly 20 so that it may make an impression when in contact with the impression roller 16. Also carried on the periphery of the drum assembly 20 is a date die 70 of the known type in which the date can be varied for imprinting. In addition to the die face 68 carrying the postmark and postage amount and the date die 70, there may be provided an advertising die slug, not shown. The postage die amount 64 of print die wheel 62 appears through a window of die face 68.

The gear 82 (FIG. 1*a*) joined to the print wheel 62 is joined in an offset manner such that the postage die amount 64 appearing in the window of the die face 68 is off center when the rotatable drum assembly 20 is in the neutral or "at rest" position illustrated in FIG. 1*a*. Since the amount 64 is off center within the die face 68, no proper aligned postage impression can be made at this position. Thus, when the rotatable die assembly 20 is in the "at rest" position shown in FIG. 1*a*, it is not possible to attempt to slip an envelope into the upper housing 18 into contact with the amount die 64 and die face 68 in order to "wipe a stamp" in violation of postage regulations. Any such impression made will not be legitimate. However, in order to insure that the postage amount die 64 and print wheel 62 are in a proper postage impression position when in contact with the ink roller 22 and the impression roller 16, there is provided a means for properly positioning the print wheel 62.

Referring first to FIGS. 1*a*, 4 and 7, there is seen an elbow shaped lever arm 90 which pivots about the shaft 66 and carries a spindle 92 about which rotates the gear 80. At the other end of the lever arm 90, there is secured a shaft 94 the end of which is formed as a cam follower 96. The cam follower 96 is in a cam track 98 which is disposed in the end plate 24. Upon rotation of the drum assembly 20, the cam follower 96 follows the cam track 98 and pivots the arm 90 about the spindle 66.

There can be seen that in the neutral or "at rest" position of FIG. 1*a*, the cam track 98 has a limited dwell position 100 in which the cam follower 96 rests. In this position, the selector dial 74 may be rotated to select the amount die 64 on the periphery of the print wheel 62 and simultaneously activate the corresponding teeth of the ducking tooth actuator 86. Also in this dwell position, the amount die 64 is off-center so that no proper impression can be made. Upon rotation of the drum assembly 20 (arrow 27), the cam follower 96 follows the cam track 98 causing the arm 90 to pivot about the shaft 66 in a counterclockwise direction. This causes the gear 80 to disengage from the selector dial 74 through the pivotal movement of the lever arm 90, its teeth 78 engage a fixed pin 102 so that the gear 80 is locked in position and can no longer be rotated.

At approximately the same time, the pivotal swinging motion of the gear 80 which disengages it from the rotating selector dial 74 causes the gear teeth 78 of gear 80 and the teeth 72 of the selector dial 74 to disengage from one another in an arcing manner. This arcing withdrawal takes place along a line through the center of the respective spindles, 92 and 44, of the components. As a consequence, the tips of teeth 78 strike the tips of the teeth 72, causing the gear 80 to rotate slightly in a clockwise manner. This causes the gear 82, and the affixed print wheel 62, to rotate slightly in a counterclockwise manner. This slight rotation of the print wheel 62 is predesigned to be of a degree sufficient to center the amount of die 64 so that a proper aligned postage impression may be made. This is shown in FIGS. 2*a* and 3*a*, where it can be seen that the gear 80 has already become fixed by the pin 102, and the amount die 64 is in a proper aligned position for inking by roller 22. In FIG. 3*a* the die 64 is still in proper position for forming an impression as it passes the impression roller 16. The die 64 remains in this position until returning to the neutral or "at rest" position where a different amount may be selected.

As the drum assembly 20 is operatively rotated to dispense a postage value, the planetary gear 46 rotates the selector dial 74. The teeth 86 on the dial 74 drive the gear 56 to register an input into the registers 50 and 52 of the amount dispensed. As aforementioned, once the drum assembly 20 begins its rotation, access to selector dial 74 is no longer possible, and thus, the amount that had been previously selected for imprinting is the amount which is registered in the numerical registers 50 and 52. If desired, a lockout may be provided, that locks the selector dial 74, once rotation of the drum assembly 20 begins. After a proper postage impression has been made and the amount registered in the numerical registers, the cam track can be so designed so as to displace the gear 80 and cause a misalignment of the die face 64 once again. Alternatively, the housing can be provided with suitable baffles at this position to avoid any possibility of "wiping a stamp". Appropriate means, not shown, are provided to limit the rotation of the drum assembly 20 in direction 27 so that it cannot be turned backwards. This will prevent the "wiping of a stamp" after the impression is made.

When the descending counter 50 exhausts the prepaid postage, an appropriate lockout mechanism for locking the register and preventing further effective postage printing operations can be provided. It will also be understood by those skilled in this art that the housing 18 or drum assembly 20, can be provided with suitable locking means which may only be opened by postal authorities when it is necessary to reset the descending balance counter 50 upon the purchase of additional postage for dispensation.

Thus, there has been described an embodiment of a postage meter in which the selection mechanism, the variable printing die, and the numerical registers are all mounted within a rotatable drum assembly for minimization of parts and convenience of operation. This postage meter is provided with security features which assure that there is no unauthorized use of the meter to obtain postage stamp impressions except in a manner resulting in register of the amount dispensed in numerical registers. In addition, the amount put into the numerical registers is that selected for the printing die and cannot be altered in operation.

Numerical registers which may be advantageously utilized in this low cost portable postage meter may be standard Veeder/Root registers having reset values of $10,000.00 to provide reliability, low cost, light weight and the savings associated therewith. The descending register 50 may be modified to include a lock out comb, as is known for postage meters, to assure that no further postage may be dispensed once the prepaid value has been reached.

Many obvious modifications and changes other than those mentioned herein, will likely occur to the skilled practitioner of this art.

All such changes are deemed to be within the full spirit and scope of this invention as represented by the appended claims.

What is claimed is:

1. A postage meter having a drum support and a rotatable drum carried for rotation upon said support, said rotatable drum comprising a directly accessible, hand manipulative postage value selector means supported by, an rotatable with said drum for manually setting a postage value to be printed, a variable postage value printing means supported by said drum for rotation therewith and operatively connected to said selector means, said printing means printing an amount of postage in accordance with the amount set by said selector means, and a postage registering means supported by said drum for rotation therewith and operatively engageable with said selector means for accounting for postage which is set and printed, said printing means and said registering means being operative only when said drum is caused to rotate from a rest position through a postage metering cycle, said postage printing means comprising at least one rotatable die wheel having a plurality of postage values upon a periphery thereof, the die wheel being rotatably movable between an offset print position and a properly aligned print position upon rotation of said drum from the rest position through said metering cycle.

2. The postage meter of claim 1, further comprising a stationary sun gear carried by said drum support, said drum rotating about said sun gear, and wherein said selector means comprises a planetary gear that is engagable with said sun gear and revolves about said sun gear when said drum is caused to rotate through a metering cycle.

3. The postage meter of claim 1, wherein said drum support comprises a Geneva mechanism in combination with the sun and planetary gears for causing said drum to accelerate from said rest position, rotate with substantially constant velocity through a printing portion of said metering cycle, and decelerate back to the rest position.

4. The postage meter of claim 1, wherein said selector means comprises a selector wheel and a ducking gear integrally operative with said selector wheel, such that as a postage amount is selected by turning said selector wheel, teeth of said ducking gear are caused to be displaced.

5. The postage meter of claim 4, wherein said register means comprises an input gear that is operatively engagable with said ducking gear of said selector means.

6. The postage meter of claim 1, wherein said printing means and said register means are each operatively connected to said selector means by interconnecting gear drives.

7. The postage meter of claim 6, wherein the interconnecting gear drive between the printing means and the selector means comprises a pivotable gear that is engagable with the selector means when said drum is in a rest position, and which pivots out of engagement with the selector means when said drum is caused to rotate through a metering cycle.

8. The postage meter of claim 7, wherein said drum support comprises a camming track, and wherein said pivotable gear is connected to a pivoting lever at one end thereof, lever, said pivoting lever carrying a cam follower on another end thereof, said cam follower riding upon the camming track, whereby the pivoting lever is caused to pivot the pivotable gear out of engagement with the selector means when the drum is rotated about said camming track.

9. The postage meter of claim 8, wherein said drum comprises a locking pin, said pivotable gear being engagable with said locking pin when said pivotable gear is caused to pivot out of engagement with said selector means, said locking pin causing said pivotable gear to be locked against rotation when engaged therewith.

10. A postage meter having a drum support and a rotatable drum carried for rotation upon said support, said rotatable drum comprising a postage value selector means, a variable postage value printing means, and a postage registering means, each of which is supported by said drum and rotatable therewith, means operatively connected to said drum for rotating said drum from a rest position through a metering cycle, said printing means comprising at least one rotatable die wheel containing a plurality of postage values upon a periphery thereof, said die wheel being rotatably movable between an offset position and a properly aligned print position upon rotation of said drum from the rest position through said metering cycle.

11. The postage meter of claim 10, further comprising a stationary sun gear carried by said drum support, said drum rotating about said sun gear, and wherein said selector means comprises a planetary gear that is engaged with said sun gear and revolves about said sun gear as said drum is caused to rotate through a metering cycle.

12. The postage meter of claim 11, wherein said drum support comprises a Geneva mechanism in combination with the sun and planetary gears for causing said drum to accelerate from said rest position, rotate with substantially constant velocity through a printing portion of said metering cycle, and decelerate back to the rest position.

13. The postage meter of claim 10, wherein said selector means comprises a selector wheel and a ducking gear integrally operative with said selector wheel, such that as a postage amount is selected by turning said selector wheel, teeth of said ducking gear are caused to be displaced.

14. The postage meter of claim 13, wherein said register means comprises an input gear that is operatively engagable with said ducking gear of said selector means.

15. The postage meter of claim 10, wherein said printing means and said register means are each operatively connected to said selector means by interconnecting gear drives.

16. The postage meter of claim 15, wherein the interconnecting gear drive between the printing means and the selector means comprises a pivotable gear that is engagable with the selector means when said drum is in a rest position, and which pivots out of engagement with the selector means when said drum is caused to rotate through a metering cycle.

17. The postage meter of claim 16, wherein said drum support comprises a camming track, and wherein said pivotable gear is connected to a pivoting lever at one end thereof, said pivoting lever carrying a cam follower on another end thereof, said cam follower riding upon the camming track, whereby the pivoting lever is caused to pivot the pivotable gear out of engagement with the selector means when the drum is rotated about said camming track.

18. The postage meter of claim 17, wherein said drum comprises a locking pin, said pivotable gear being engagable with said locking pin when said pivotable gear is caused to pivot out of engagement with said selector means, said locking pin causing said pivotable gear to be locked against rotation when engaged therewith.

19. A postage meter comprising a rotatable drum assembly, a selectable postage value printing means carried by the drum assembly, a setting means carried by the drum assembly for setting the value to be printed, first connecting means for operably connecting the setting means to the printing means so that actuation of the setting means to set a value causes a corresponding setting of the value in the printing means, register means carried by the drum assembly, second connecting means for operatively connecting the setting means to the register means so that activation of the setting means to set a value causes a corresponding adjustment in the register means upon rotation of the drum assembly, means for rotating the drum assembly to print a postage value from the value printing means, cam means operatively connected to, and actuatable by rotation of the drum assembly, the setting means and printing means being connected when the drum assembly is in a rest position, and being disconnected by said cam means when the drum assembly is rotated to provide a printing of a postage value, the first connecting means being disconnected from the setting means and causing a positioning of the printing means to a properly aligned postage value printing position, when the drum assembly is rotated.

* * * * *